US008276601B2

(12) United States Patent
Hanson et al.

(10) Patent No.: US 8,276,601 B2
(45) Date of Patent: Oct. 2, 2012

(54) CLEANING VESSEL

(75) Inventors: Jeff Andrew Hanson, Beeliar (AU); Ante Perak, Hamilton Hill (AU); Edward Joseph Khoury, Bateman (AU)

(73) Assignees: Jeff Andrew Hanson, Beeliar, Western Australia (AU); Ante Perak, Hamilton Hill, Western Australia (AU)

( * ) Notice: Subject to any disclaimer, the term of this patent is extended or adjusted under 35 U.S.C. 154(b) by 0 days.

(21) Appl. No.: 13/181,720

(22) Filed: Jul. 13, 2011

(65) Prior Publication Data

US 2011/0297195 A1 Dec. 8, 2011

Related U.S. Application Data

(63) Continuation of application No. PCT/AU2010/000038, filed on Jan. 15, 2010.

(30) Foreign Application Priority Data

Jan. 15, 2009 (AU) ..... 2009900154
Mar. 18, 2009 (AU) ..... 2009901164

(51) Int. Cl.
*B08B 3/04* (2006.01)

(52) U.S. Cl. ..... 134/104.2; 134/110; 366/138

(58) Field of Classification Search ..... 366/138; 134/104.2, 110
See application file for complete search history.

(56) References Cited

U.S. PATENT DOCUMENTS 1,947,844 A * 2/1934 Gish ..... 494/48
2,061,564 A * 11/1936 Drake et al. ..... 261/93
2,286,979 A * 6/1942 Samuel ..... 209/159
2,495,147 A * 1/1950 Street ..... 264/8
2,849,215 A * 8/1958 Hurst ..... 366/138
3,396,844 A * 8/1968 Millhiser et al. ..... 209/724
3,972,815 A * 8/1976 O'Cheskey et al. ..... 210/219
4,379,749 A * 4/1983 Roth ..... 210/167.18
4,641,673 A 2/1987 Conley et al.
4,708,152 A 11/1987 Hibberd
5,039,400 A * 8/1991 Kallioinen et al. ..... 209/164
5,061,375 A * 10/1991 Oyler ..... 210/744
5,341,938 A * 8/1994 Valenzuela et al. ..... 209/164
6,109,449 A * 8/2000 Howk et al. ..... 209/169

(Continued)

FOREIGN PATENT DOCUMENTS

DE 34 17 204 * 6/1985

(Continued)

OTHER PUBLICATIONS

International Search Report from PCT/AU2010/000038, filed Jan. 15, 2010, mailed Mar. 29, 2010.

*Primary Examiner* — Frankie L Stinson
(74) *Attorney, Agent, or Firm* — Patentbar International P.C.

(57) ABSTRACT

A cleaning vessel (10) comprising a main chamber (12) into which can be inserted a part (34) for cleaning and one or more secondary chambers (14). An opening (30) is provided in the main chamber (12) associated with each secondary chamber (14) such that the main chamber (12) is in fluid communication with each secondary chamber (14). Rotation of the part (34) causes rotational flow of fluid in the main chamber (12) and each opening (30) is oriented such that material entrained in the rotating fluid passes from the main chamber (12) into the associated secondary chamber (14).

28 Claims, 21 Drawing Sheets

Fig 1

U.S. PATENT DOCUMENTS

| | | | | |
|---|---|---|---|---|
| 6,214,237 | B1 * | 4/2001 | Kustra et al. | 210/709 |
| 6,341,887 | B1 * | 1/2002 | Hansen, Sr. | 366/138 |
| 7,229,206 | B2 | 6/2007 | Whitney | |
| 7,971,732 | B2 * | 7/2011 | Weis et al. | 210/532.1 |
| 2008/0042035 | A1 * | 2/2008 | Elwood | 248/346.03 |

FOREIGN PATENT DOCUMENTS

| | | | |
|---|---|---|---|
| FR | 2 259 541 | * | 10/1975 |
| JP | 10-174569 | * | 6/1989 |
| JP | 02-095427 | * | 4/1990 |
| JP | 03-262597 | * | 11/1991 |
| JP | 04-332510 | * | 11/1992 |
| JP | 06-047207 | * | 2/1994 |
| JP | 2003-109107 | * | 4/2003 |
| JP | 2006-026627 | * | 2/2006 |
| JP | 2008-307507 | * | 12/2008 |
| RU | 1669487 | * | 8/1991 |

* cited by examiner

CLEANING VESSEL

RELATED APPLICATIONS

This application is a Continuation application of International Application PCT/AU2010/000038, filed on Jan. 15, 2010, which in turn claims priority to Australian Patent Applications No. AU 2009901164, filed Mar. 18, 2009 and AU 2009900154, filed Jan. 15, 2009, all of which are incorporated herein by reference in their entirety.

FIELD OF THE INVENTION

The present invention relates to a cleaning vessel, in particular a vessel to be used for cleaning rotatable parts such as mixing attachments.

BACKGROUND OF THE INVENTION

Many tradespeople require the use of implements to mix materials for their work. Plasterers for example commonly use a mixing attachment that connects to a drill for mixing plaster. A similar mixing attachment is used by many other trades for mixing similar compounds such as paint.

One particular problem with such mixing implements is the time required for cleaning. If the attachment is not cleaned promptly after mixing, the mixture left on the attachment will set, after which cleaning will become far more difficult. However, as materials such as plaster only provide a certain amount of time in which they can be worked, stopping to clean the mixing attachment immediately after use reduces the time available to use the plaster before it sets.

A common method of cleaning such a mixing attachment is to simply place the attachment in a bucket of water and to rotate the attachment with the drill. While such a method does remove a significant amount of the material from the attachment, it will also generally leave some residue which must be wiped from the attachment, thereby increasing the time lost in the cleaning process. One particular problem is that the material removed from the mixing attachment will simply fall to the bottom of the bucket. Rotation of the mixing attachment stirs up this material which is then left on the attachment. The problem also becomes worse as the bucket is re-used a number of times creating a larger layer of material on the base of the bucket.

The present invention attempts to overcome, at least in part, the abovementioned problems associated with cleaning rotatable parts such as mixer attachments.

SUMMARY OF THE INVENTION

In accordance with the present invention, there is provided a cleaning vessel comprising:

a main chamber into which can be inserted a part for cleaning;

one or more secondary chambers; and openings provided in the main chamber such that the main chamber is in fluid communication with each secondary chamber;

wherein rotation of the part causes rotational flow of fluid in the main chamber and each opening is oriented such that material entrained in the rotating fluid passes from the main chamber into the secondary chamber.

Preferably the main chamber comprises a cylindrical chamber such that rotation of the part creates a circular flow of fluid within the main chamber. Preferably a plurality of openings are provided in a side wall of the main chamber spaced evenly around the main chamber such that circular flow of fluid around the main chamber passes across the openings.

In a preferred embodiment, the openings are provided in the side wall of the main chamber at a location above lower ends of the main chamber and the secondary chambers.

Each of the openings is preferably provided with a vane extending inwardly from the side wall of the main chamber on a first side of the opening, the vane being angled such that fluid passing across the opening from a second side towards the first side is directed through the opening into the secondary chamber.

In one embodiment, the secondary chambers each comprise a cylindrical chamber and fluid entering each secondary chambers creates a circular flow within the secondary chamber in a direction opposite to that in the main chamber. The main and secondary chambers each preferably comprise cylindrical vessels and each secondary chamber includes a side wall portion common with a side wall portion of the main chamber in which the opening is provided.

The openings are preferably provided adjacent upper ends of the secondary chambers. In one embodiment, the main chamber is provided with two secondary chambers located on opposite sides of the main chamber. The secondary chambers may each include a closed upper end and open lower end having a removable cap member. In one embodiment, the secondary chambers are tapered such that the upper ends thereof are narrower than the lower ends and the upper closed end extends downwardly away from the opening to direct fluid flowing from the main chamber downwardly.

In a further embodiment, the secondary chambers are provided as separate cylindrical vessels securable to and releasable from the main chamber each having an opening which aligns with a corresponding opening in the main chamber when the cylindrical vessel is attached to the main chamber. Preferably the main chamber is provided with a pair of outwardly extending tabs adjacent the lower end thereof each having an upturned end and the tabs are received in corresponding slots adjacent the lower ends of the secondary chambers.

Pivotable clips may be provided on the main chamber adjacent upper ends of the secondary chambers such that when the secondary chambers are in position and engaged with the tabs, the clips pivot over and engage with the upper ends of the secondary chambers to hold the secondary chambers in place. Upper ends of the secondary chambers may be provided with removable caps.

Preferably a pair of foot pedals is provided extending outwardly from opposite sides of the lower end of the main chamber. The main chamber may be provided with a base portion into which a lower end of the main chamber is received, the base portion including the foot pedals. In one embodiment, the foot pedals are pivotally connected to the base portion such that the foot pedals can be pivoted between a first in use position and a second stored position.

The lower surface of the main chamber may be provided with lower surface vanes to direct fluid flow upwardly away from the lower surface in use. The lower surface vanes preferably extend from a central position on the lower surface to the periphery thereof and have a first face angled to direct rotating fluid upward.

Preferably the upper end of the main chamber includes a cover member to limit splashing of fluid out of the main chamber in use. The cover member preferably comprises a flexible member having a central hole with a plurality of slots extending radially outwardly from a central hole.

In a preferred embodiment, a first mixing attachment holding device is provided on the edge of the main chamber adjacent the upper end thereof, the first mixing attachment holding device comprising an outwardly extending piece of material having a first groove therein such that the shaft of the mixing attachment can be received and held in the groove.

A second mixing attachment holding device is also preferably provided extending from an upper edge of the main chamber across the cover member the second mixing attachment holding device including a second groove located above one of the slots in the cover member such that the shaft of the mixing attachment can be received in the second groove with the end of the mixing attachment located in the main chamber.

In a further embodiment, an outer casing is provided into which the main chamber is received and the main chamber includes a plurality of radial vanes extending outwardly from an outer surface thereof such that the radial vanes engage an inner surface of the outer casing to define the secondary chambers.

Preferably the main chamber and outer casing are cylindrical and the main chamber is received coaxially within the outer casing.

Preferably the radial vanes are arranged longitudinally on the outer surface of the main chamber to divide the annular space defined between the outer casing and the main chamber into a plurality of segments and the openings are provided in the main chamber such that segments defined between a pair of adjacent vanes either side of an opening form the secondary chambers.

BRIEF DESCRIPTION OF THE DRAWINGS

The invention will now be described, by way of example, with reference to the following drawings in which.

DETAILED DESCRIPTION OF THE PREFERRED EMBODIMENTS

Figure 1:
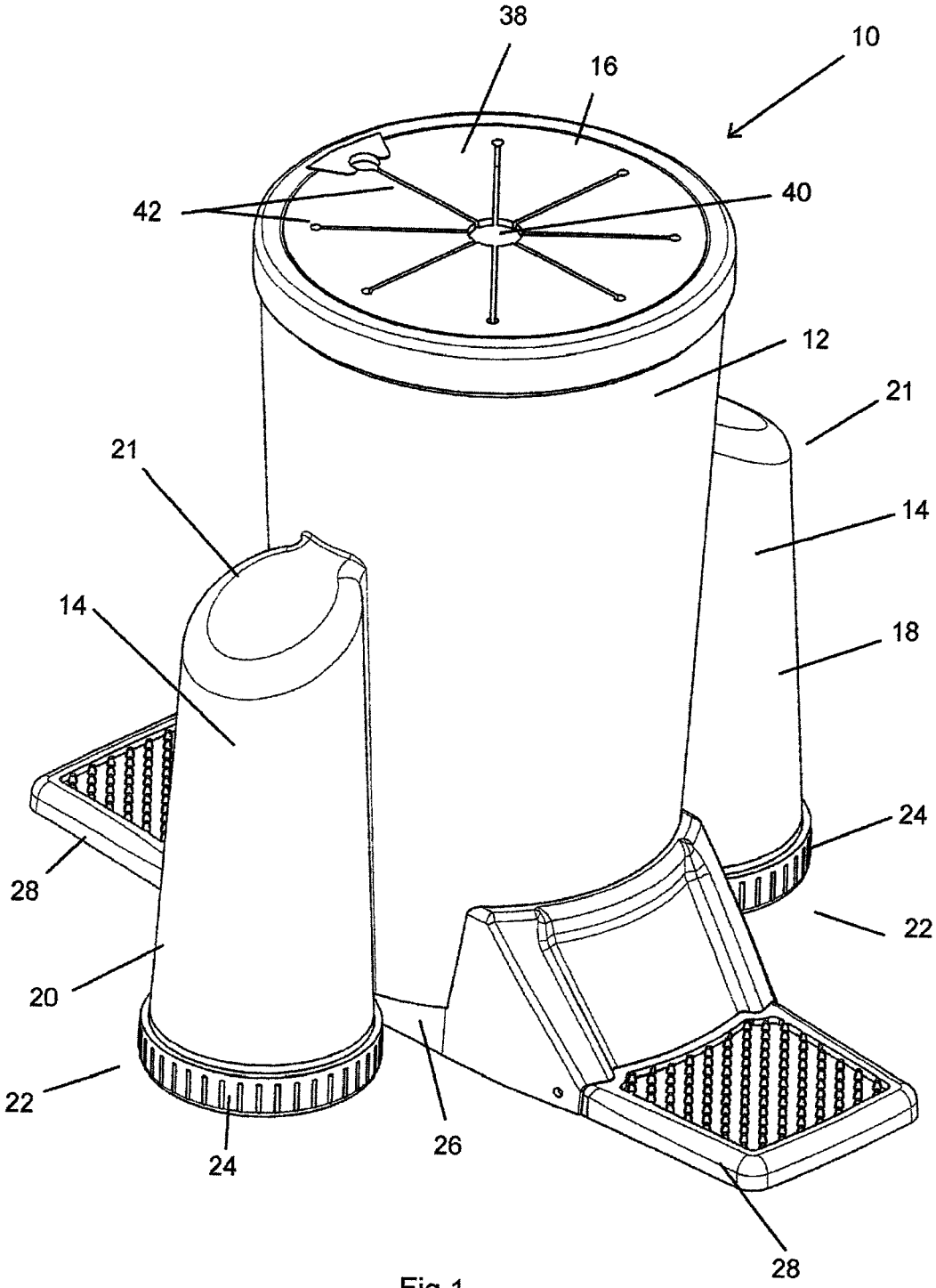
FIG. 1 is an upper perspective view of a cleaning vessel in accordance with the present invention.

Referring to FIGS. 1 to 8, there is shown a first embodiment of a cleaning vessel 10 comprising a main chamber 12 and one or more secondary chambers 14. The main chamber 12 comprises a cylindrical chamber having an open upper end 16. In the embodiment shown, the cleaning vessel 10 is provided with a first secondary chamber 18 and a second secondary chamber 20. Each of the secondary chambers 14 also comprises a cylindrical chamber. In the embodiment shown, the upper ends 21 of the secondary chambers are sealed and the lower ends 22 of the secondary chambers 14 are open. The lower ends 22 of the secondary chambers 14 are provided with removable caps 24 to seal across the open lower ends 22.

The secondary chambers 14 are located such that longitudinal axes thereof are parallel to the longitudinal axis of the main chamber 12. The secondary chambers 14 are located on opposite sides of the main chamber 12 and formed integrally with the main chamber 12 such that a portion of the side wall of the main chamber 12 forms also a portion of the side wall of the secondary chambers 14. The lower ends 22 of the secondary chambers 14 rest on the ground when the cleaning vessel 10 is placed on the ground.

Figure 2:
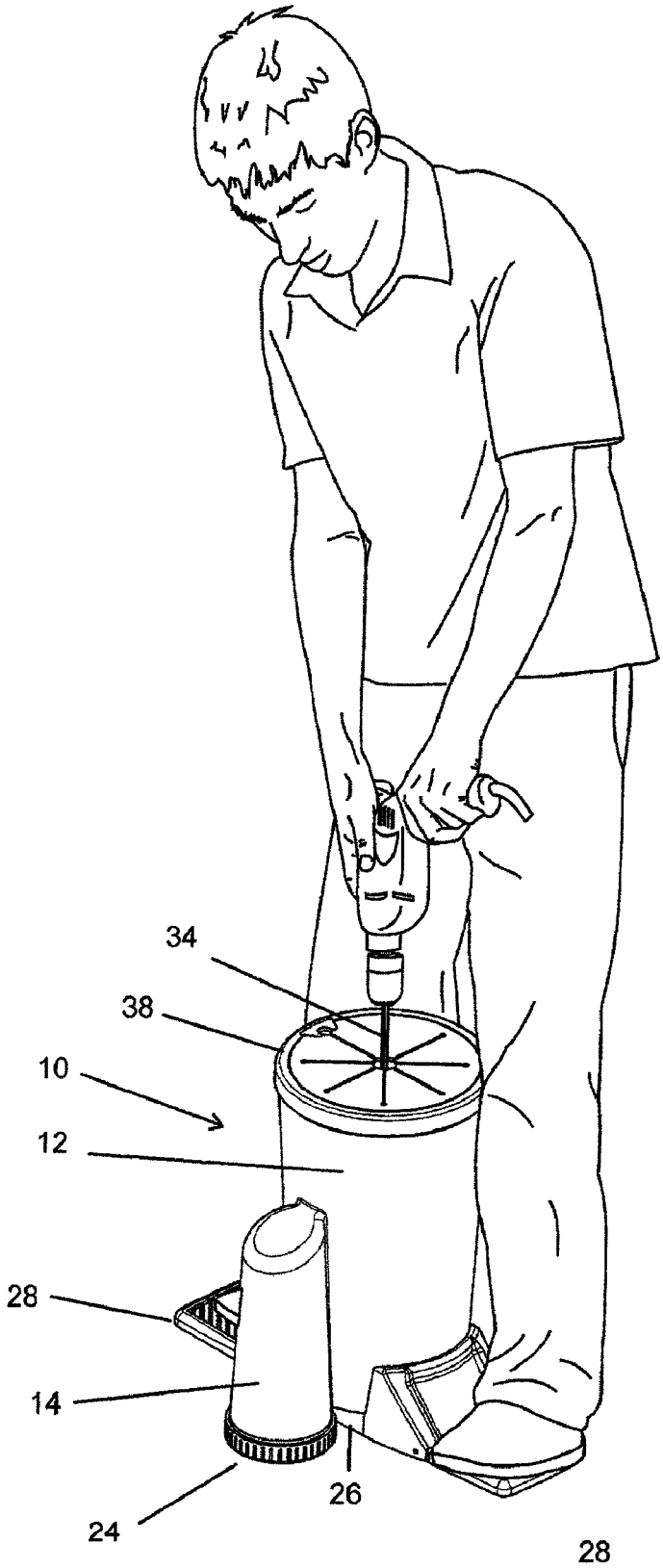
FIG. 2 is a view of the cleaning vessel of FIG. 1 in use.
Figure 3:
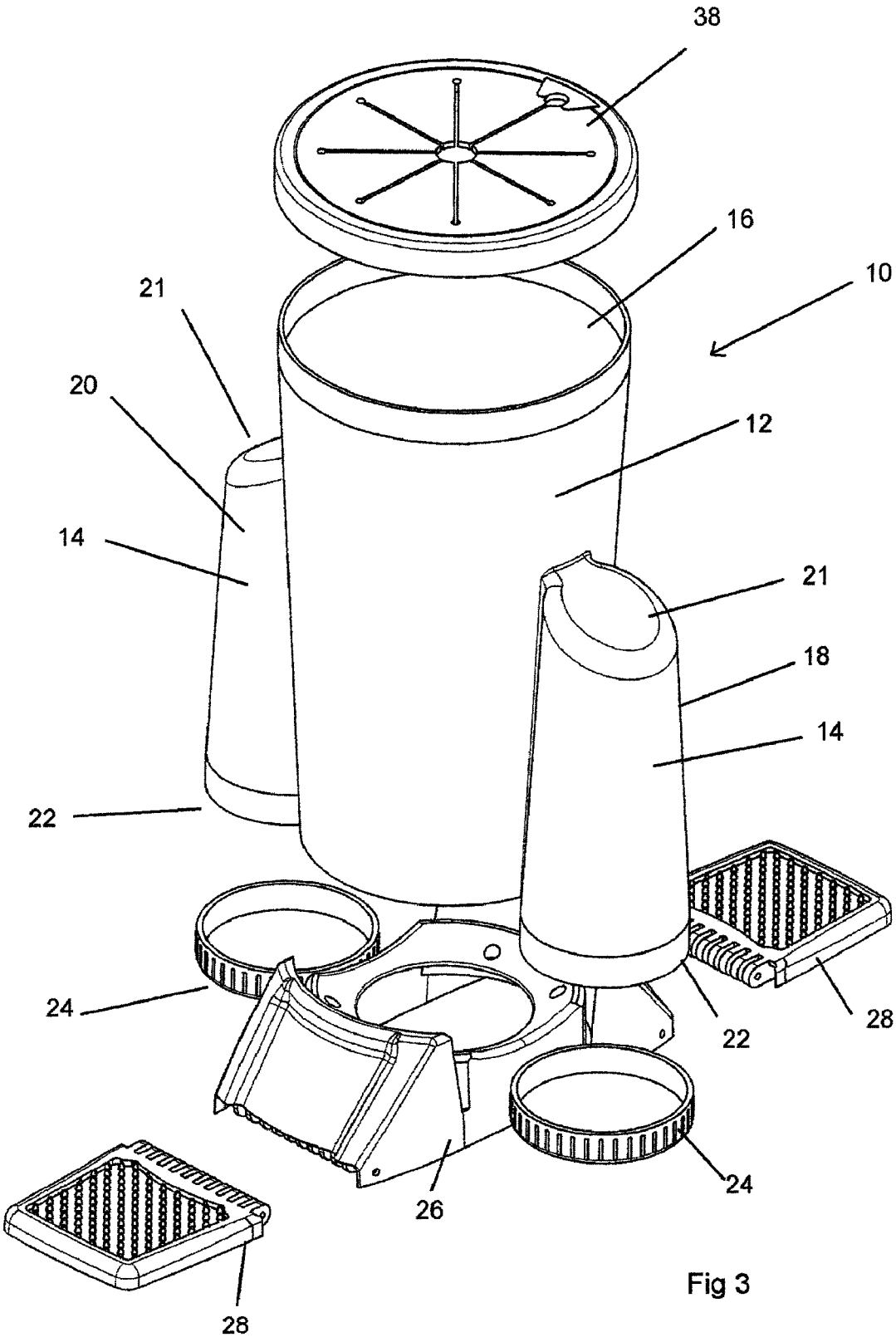
FIG. 3 is an exploded view of the cleaning vessel of FIG. 1.
Figure 7A:
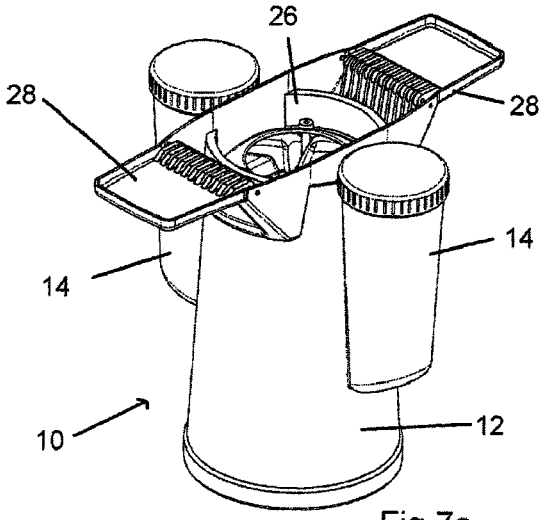
FIGS. 7*a* to 7*e* show the process of folding the foot pedals of the cleaning vessel.
Figure 7B:
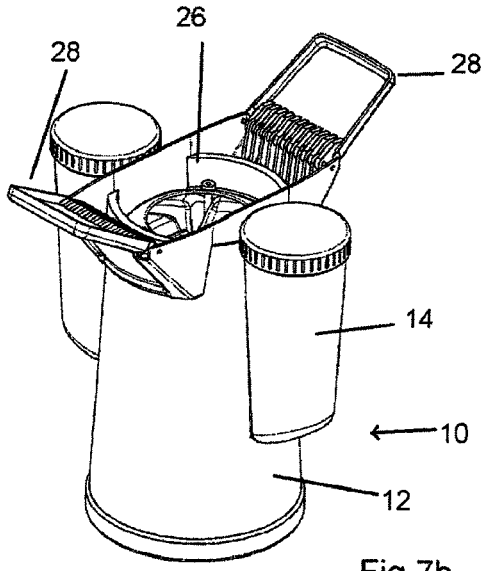
Figure 7C:
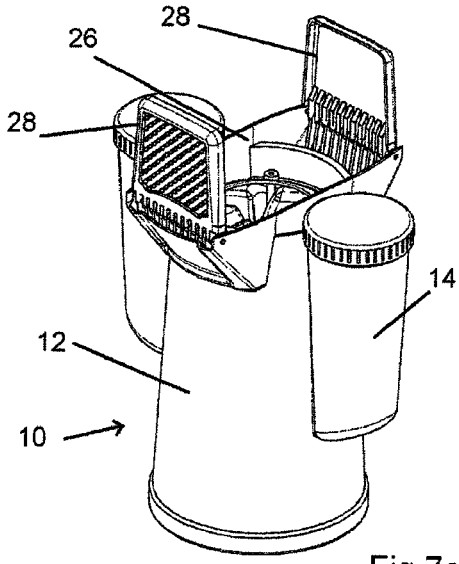
Figure 7D:
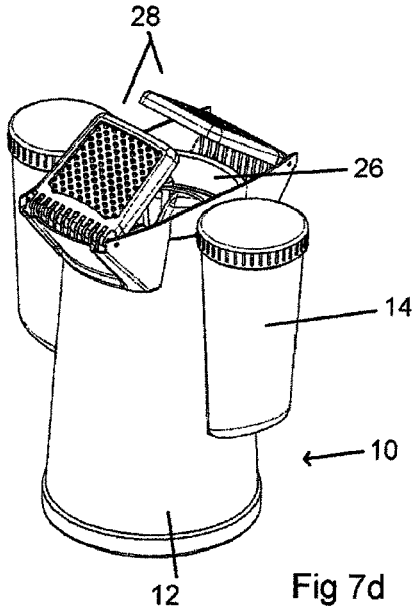
Figure 7E:
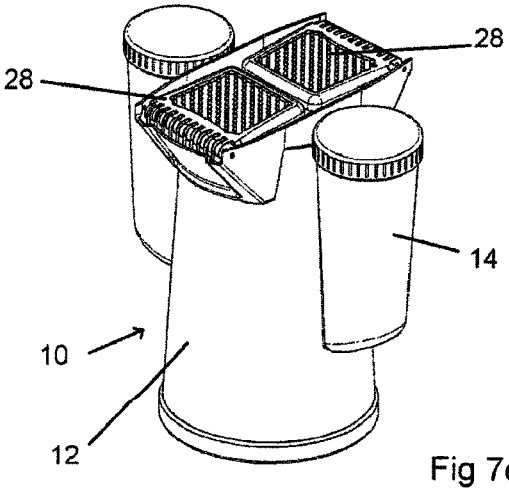

The cleaning vessel 10 is provided with a base portion 26 into which is received the lower end of the main chamber 12. In the embodiment shown, the base portion 26 includes a pair of foot pedals 28 extending outwardly therefrom on opposite sides of the main chamber 12. The foot pedals 28 are arranged such that when the base portion 26 is placed on the ground, a user of the cleaning vessel 10 can stand with one foot on either of the foot pedals 28 thereby preventing movement of the cleaning vessel 10 (as shown in FIG. 2). The foot pedals 28 are preferably pivotally connected to the base portion 26 such that the foot pedals 28 can be pivoted between a first in use position (as shown in FIG. 7*a*) and a second stored position (as shown in FIG. 7*e*). In the stored position, the foot pedals 28 are received in a recess in the lower side of the base portion 26. In a further embodiment (not shown) the foot pedals 28 may be retractable into the base portion 26 by sliding, rather than pivoting. As a further alternative embodiment, the base portion 26 may be provided with a circular flange around the periphery thereof, wherein the user can place their feet on the flange on opposite sides of the cleaning vessel 10.

Figure 4:
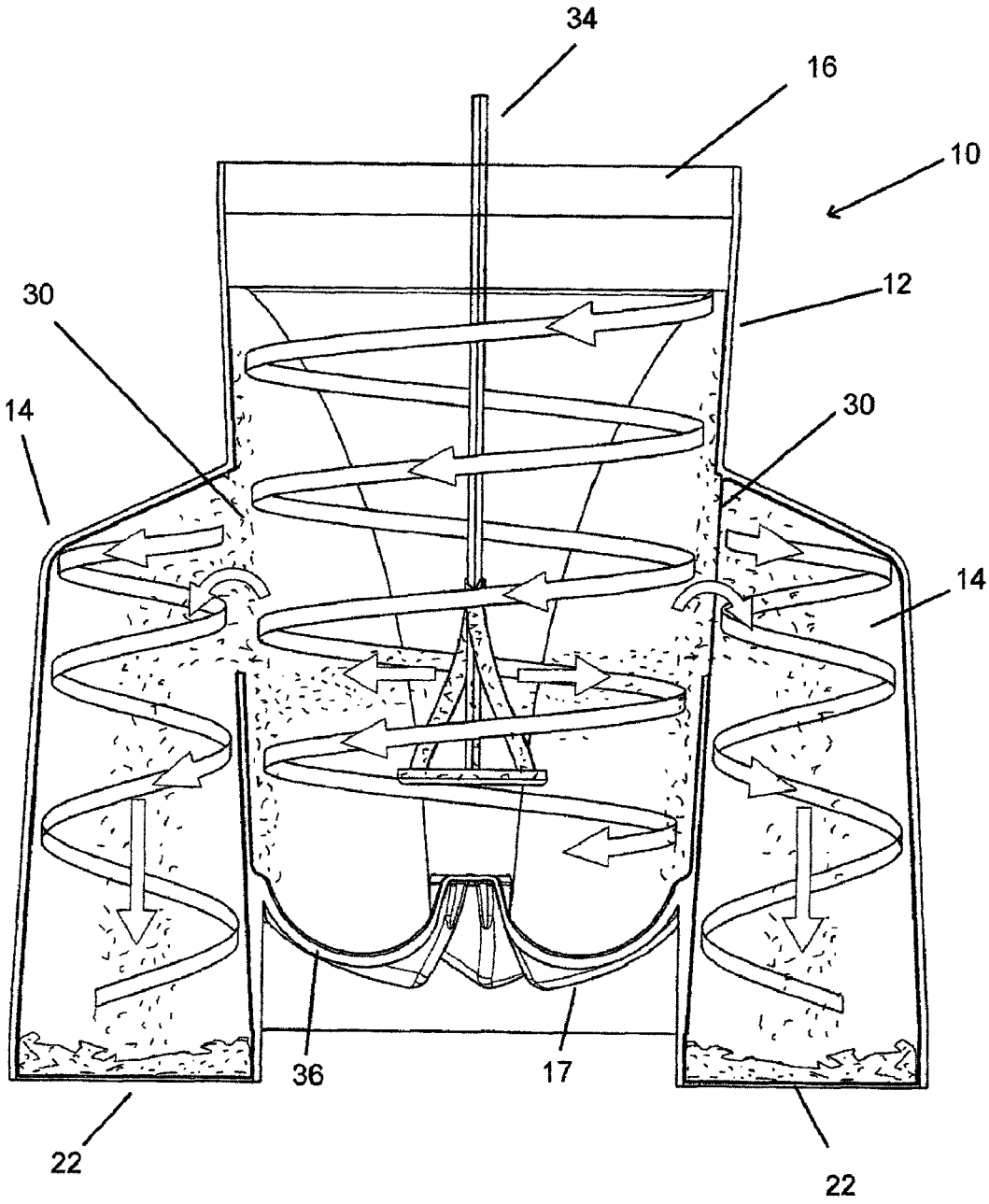
FIG. 4 is a side cross sectional view of the cleaning vessel of FIG. 1 showing the direction of fluid flow in use.

The main chamber 12 is provided with openings 30 (as can be seen in FIG. 4) in the portion of the side wall thereof common with the secondary chambers 14. That is, each opening 30 extends from the main chamber 12 into an associated one of the secondary chambers 14. The openings are each oriented such that that when fluid within the chamber 12 is moving around the main chamber 12, fluid flow adjacent the side wall is directed through the openings 30 into the secondary chambers 14. While in the embodiment shown, two secondary chambers 14 are provided, it will be appreciated that more secondary chambers 14 may also be provided each having an associated opening 30. The secondary chambers 14 and associated openings 30 would preferably be spaced evenly around the side wall of the main chamber 12.

Figure 8:
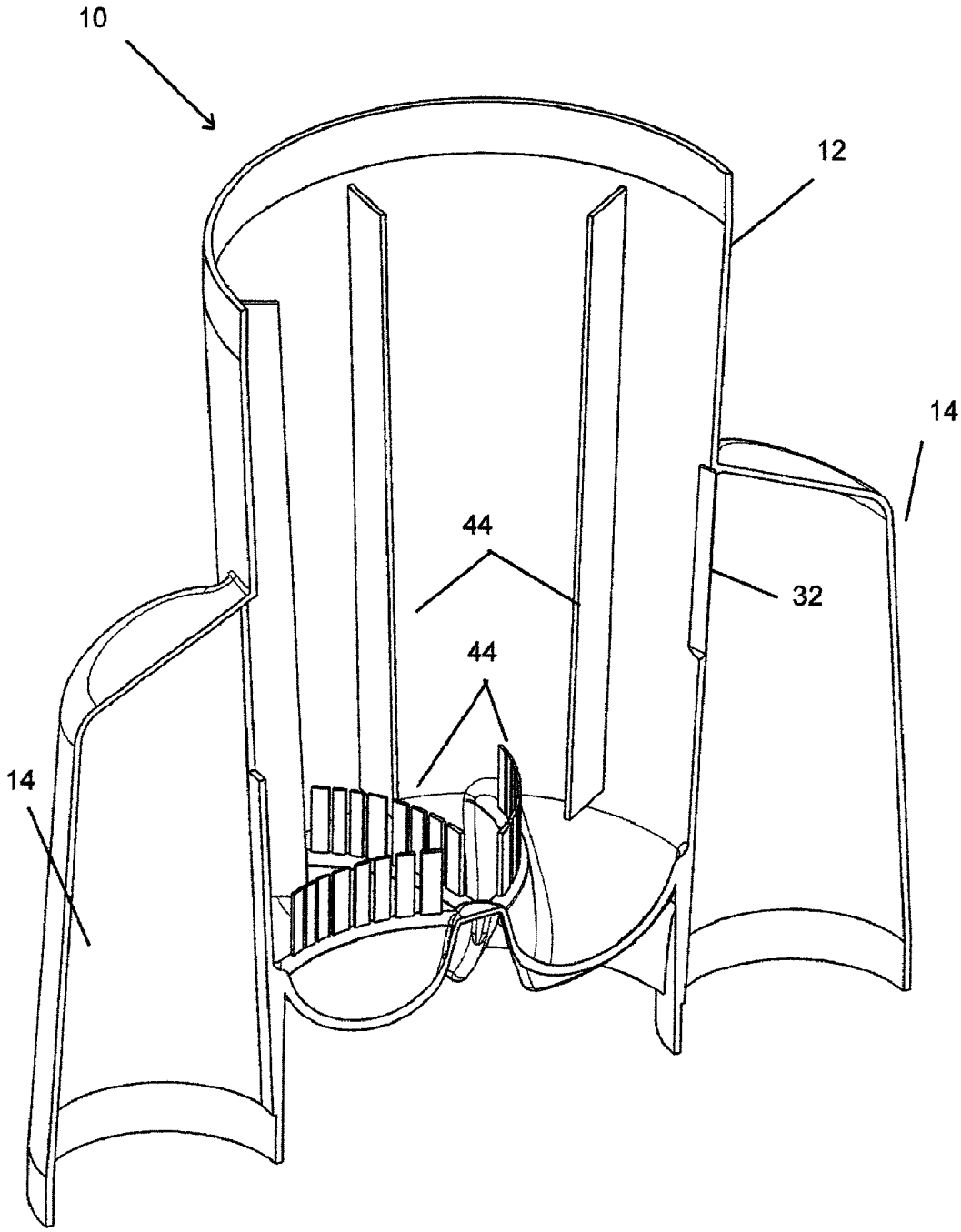
FIG. 8 is a view of a further embodiment of a cleaning vessel with side walls cut away showing fins for agitating the fluid flow.
Figures 9A, 9B, 9C:
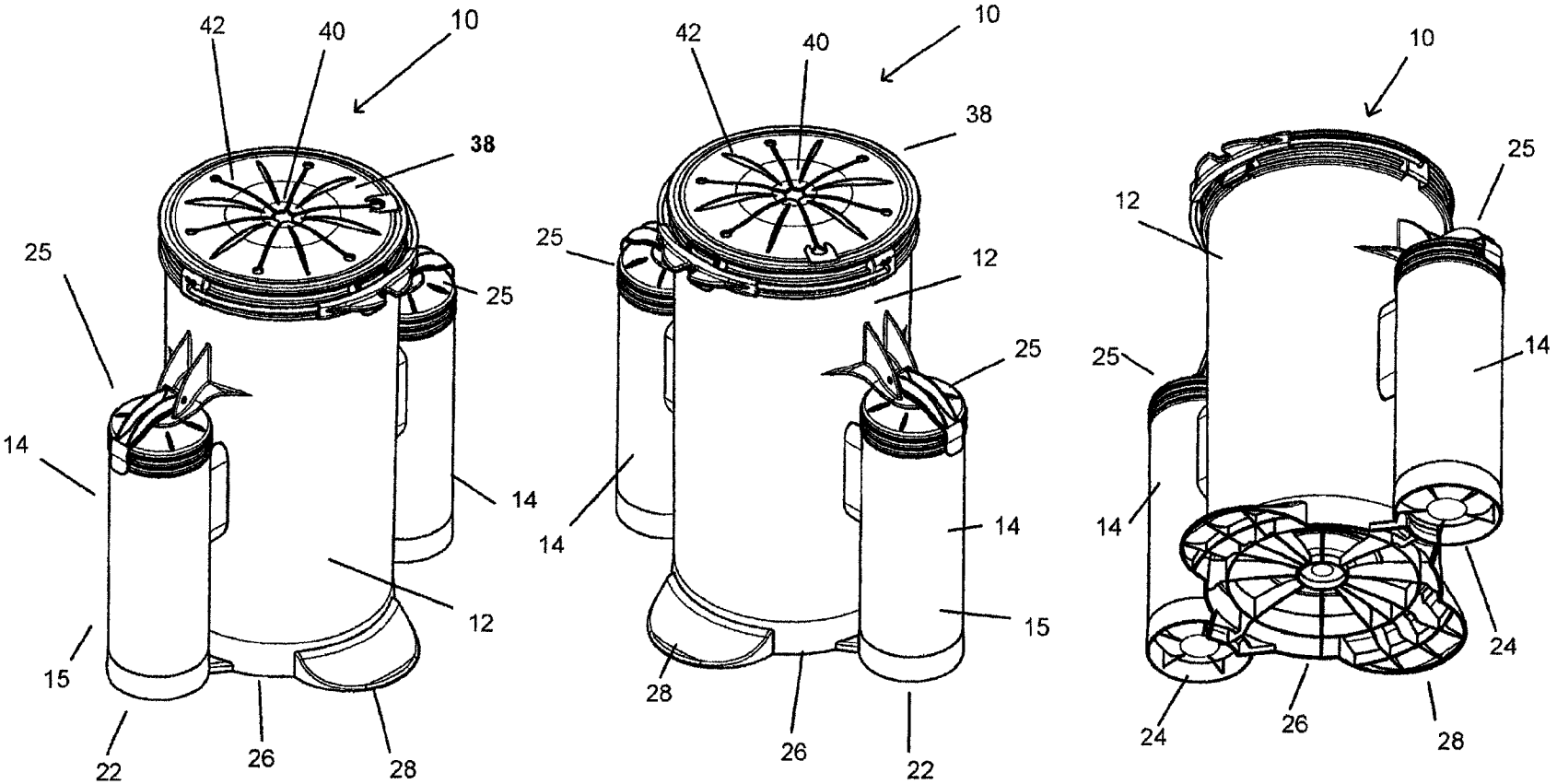
FIG. 9*a* is a first upper perspective view of a second embodiment of a cleaning vessel in accordance with the present invention.
FIG. 9*b* is a second upper perspective view of the cleaning vessel of FIG. 9*a;*
FIG. 9*c* is a lower perspective view of the cleaning vessel of FIG. 9*a;*
Figure 10:
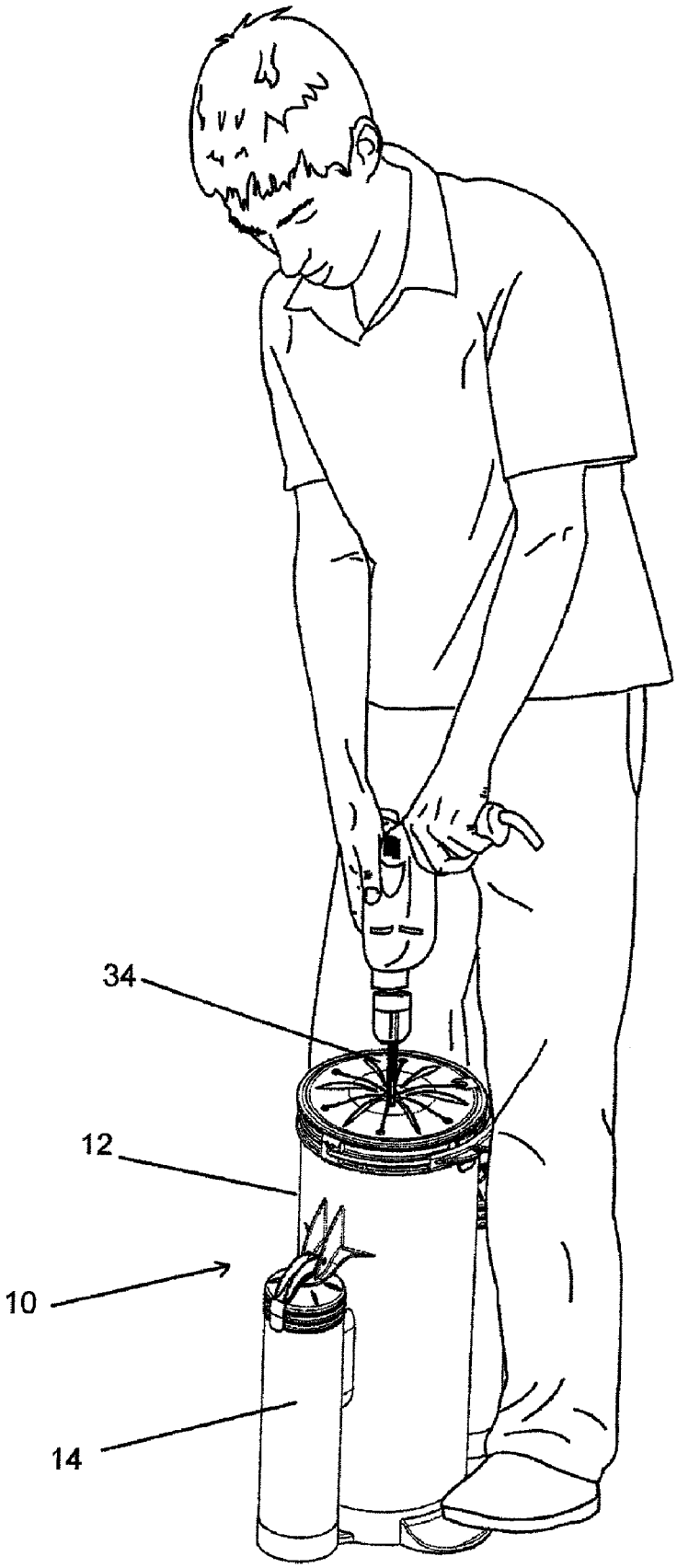
FIG. 10 is a view of the cleaning vessel of FIG. 9 in use.

In the embodiment shown, each of the openings 30 is provided with an associated vane 32 to direct fluid flow into the secondary chamber 14 (as can be best seen in FIG. 8). The vanes 32 extend inwardly from the side wall of the main chamber 12 on a first side of the associated opening 30. The vanes 32 are angled such that when fluid within the chamber 12 is flowing in a circular motion around the main chamber 12 such that fluid passes across the opening 30 from a second side towards the first side, the vanes 32 direct fluid flow adjacent the side wall through the openings 30 into the secondary chambers 14.

The openings 30 are provided between the main chamber 12 and the secondary chambers 14 at a location above lower ends of the main chamber 12 and the secondary chambers 14.

Figure 5:
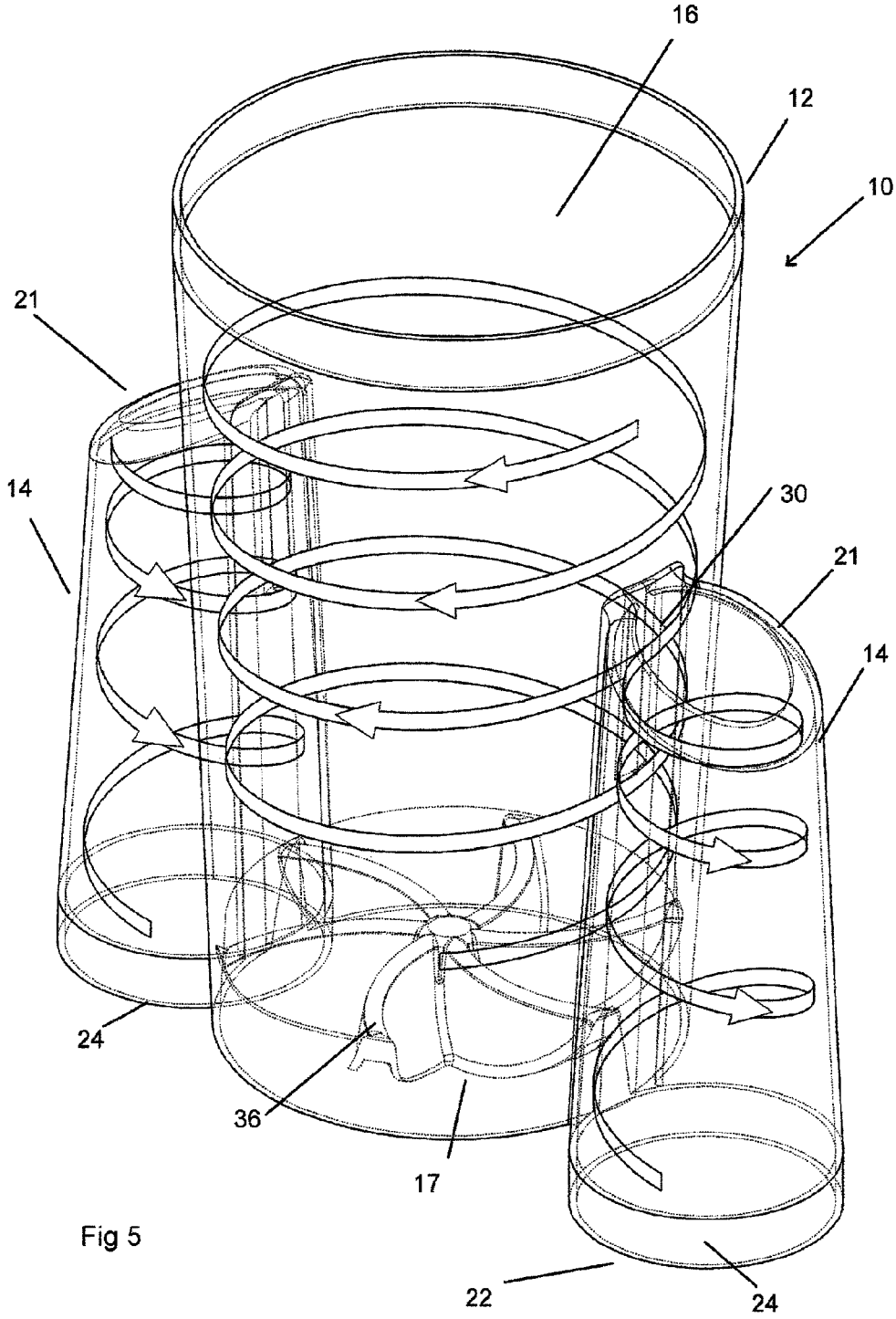
FIG. 5 is an upper perspective view of the cleaning vessel of FIG. 1 showing the direction of fluid flow.
Figure 6:
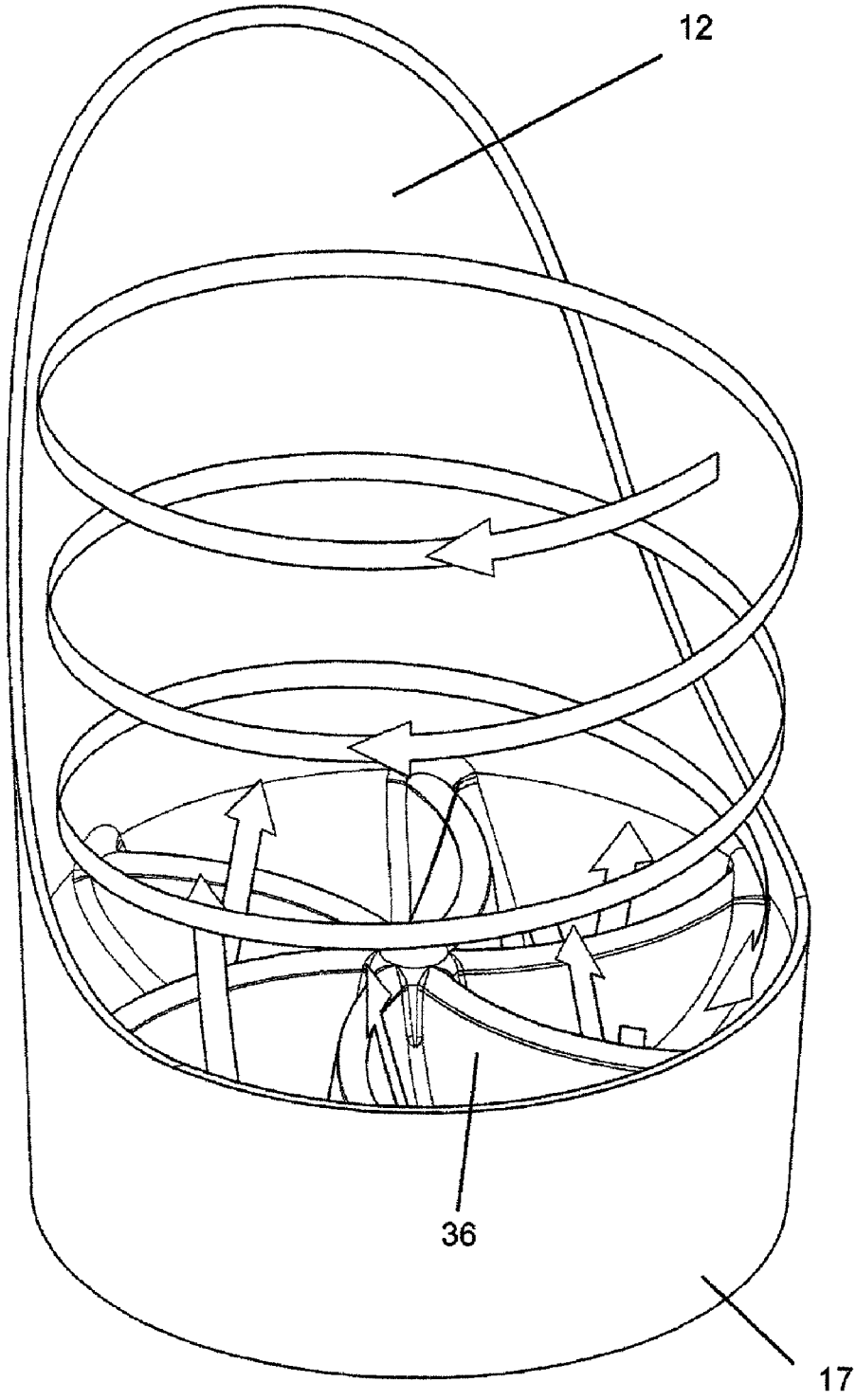
FIG. 6 is a view of the main chamber with the side walls cut away to show the direction of fluid flow created by lower surface vanes.

FIGS. 4 to 6 show the direction of fluid flow in the main and secondary chambers 12 and 14 caused by the rotation of a part, such as a mixing attachment 34, and the vanes 32. As can be seen, the fluid in the main chamber 12 is caused to flow in a circular motion in the direction of rotation of the mixing attachment 34. The vanes 32 cause a portion of the fluid flowing adjacent the side wall of the main chamber 12 to be diverted into the secondary chambers 14. As the flow of fluid entering the secondary chambers 14 is generally tangential, a rotational flow is created in the secondary chambers 14 which is opposite in direction to the rotation of fluid in the main chamber 12.

As in use the material, such as plaster, being removed from the mixing attachment 34 is expected to be relatively heavy, it will move outwardly towards the side walls of the main chamber 12. The rotational flow and the vanes 32 will therefore cause this material to pass through the openings 30 where it will follow the rotating flow in the secondary chambers 14 as shown and fall to the lower end of the secondary chambers 14. The upper ends of the secondary chambers 14 are also preferably angled to extend downwardly away from the openings 30 to further direct material entering the secondary chamber 14 towards the lower end 22 thereof. The secondary chambers 14 may also be tapered such that the secondary chambers 14 are narrower at the upper end 21 thereof than the lower end 22.

The main chamber 12 will therefore remain relatively free of material removed from the mixing attachment 34 allowing more effective cleaning. The cleaning vessel 10 can therefore be used a number of times with the removed material building up in the secondary chambers 14. When it is required to clean the vessel 10, the caps 24 can be removed from the lower ends 22 of the secondary chambers 14 to remove the build up of material. While the secondary chambers 14 in the embodiment shown have sealed upper ends 21, the upper ends 21 may also be provided with removable covers in order to provide additional access to the secondary chambers 14 for cleaning.

The main chamber 12 may also be provided with further vanes 36 on the lower surface 17 thereof. The lower surface vanes 36 of the main chamber 12 are provided to create an upward flow of fluid within the main chamber 12 (as can be seen in FIG. 6). This upward flow is expected to raise any material that does fall to the lower surface 17 of the main chamber 12 to increase the likelihood such material will be transferred to the secondary chambers 14. The lower surface vanes 36 may each extend from a central position on the lower surface 17 to the periphery of the lower surface 17. Each lower surface vane 36 may comprise a first face and a second face where the fluid flow in use is incident on the first face and the first face is angled further from the vertical than the second face such that fluid striking the first face is directed upwardly. The lower surface vanes 36 may also extend from the central position to the periphery of the lower surface 17 of the main chamber 12 in a curve.

The upper end 16 of the main chamber is also provided with a cover member 38. The cover member 38 is fitted across the open upper end 16 and comprises a flexible member having a central hole 40 with a plurality of slots 42 extending radially outwardly from the central hole 40. The flexibility of the material of the cover member 38 and the slots 42 allows the mixing attachment 34 to be pushed through the cover member 38. The cover member 38 then returns to position with the shaft of the mixing attachment 34 positioned in the central hole 40. The cover member 38 thereby limits fluid within the main chamber 12 splashing out in use.

In one embodiment, the interior of the main chamber 12 may also be provided with a plurality of fins 44. The fins 44 may extend from the inner side wall of the main chamber 12 and/or the lower surface 17. The fins 44 may be rigid or flexible and are provided for further agitating the water within the main chamber 12 to increase effectiveness of the cleaning process.

FIGS. 9 to 17 show a second embodiment of a cleaning vessel 10 in accordance with the present invention. The cleaning vessel 10 of the second embodiment operates essentially in the same manner as that of FIGS. 1 to 8 and like reference numerals are used to denote like parts.

In this embodiment, the secondary chambers 14 are provided as separate cylindrical vessels 15. The separate cylindrical vessels 15 are securable to and releasable from the main chamber 12. Each of the separate cylindrical vessels 15 is provided with an opening 30 which aligns with a corresponding opening in the main chamber 12 when the cylindrical vessel 15 is attached to the main chamber 12 such that material can pass into the secondary chambers 14 as described previously.

Figure 11:
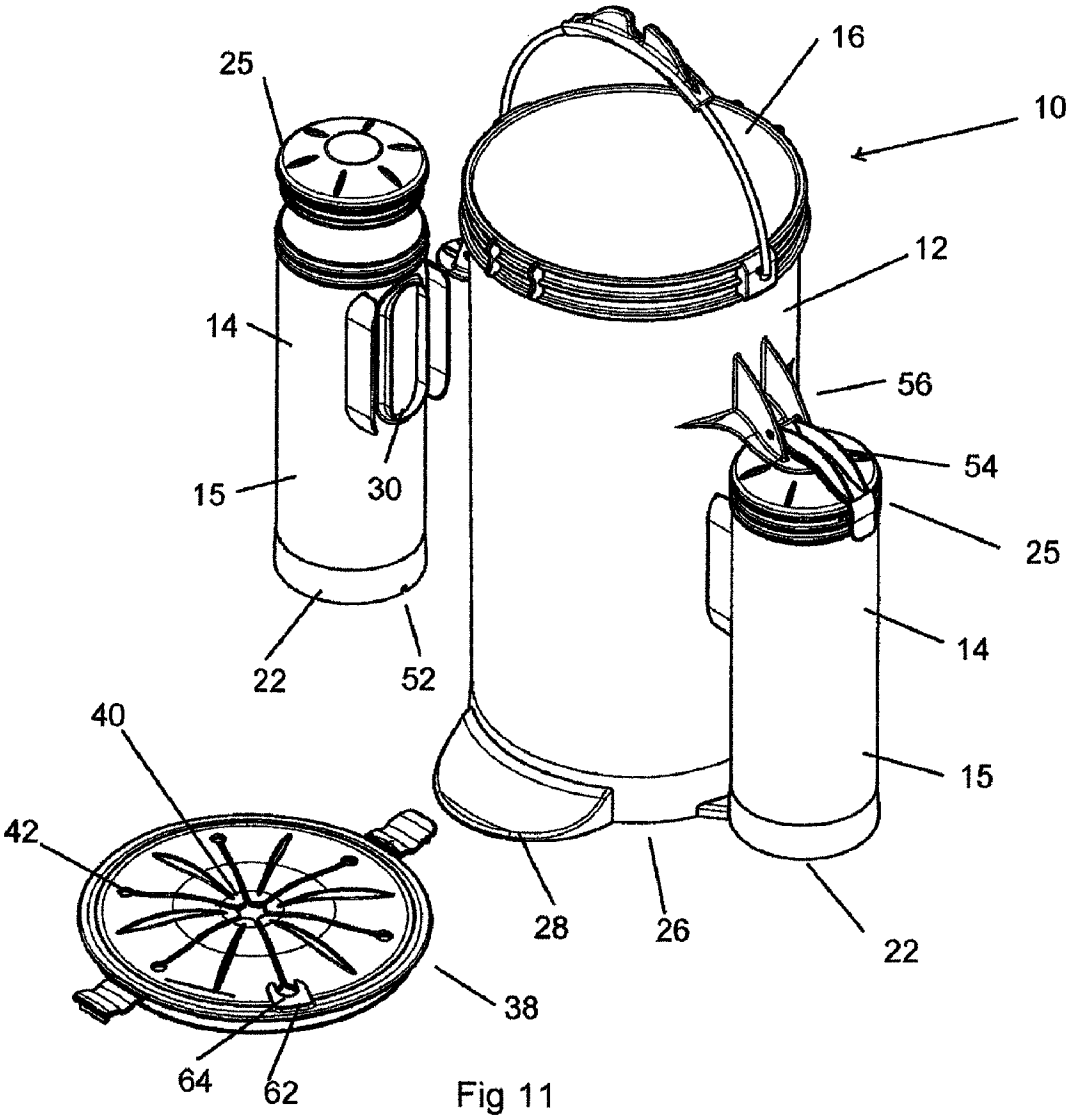
FIG. 11 is an upper perspective view of the cleaning vessel of FIG. 9 in a partially disassembled state.
Figure 12:
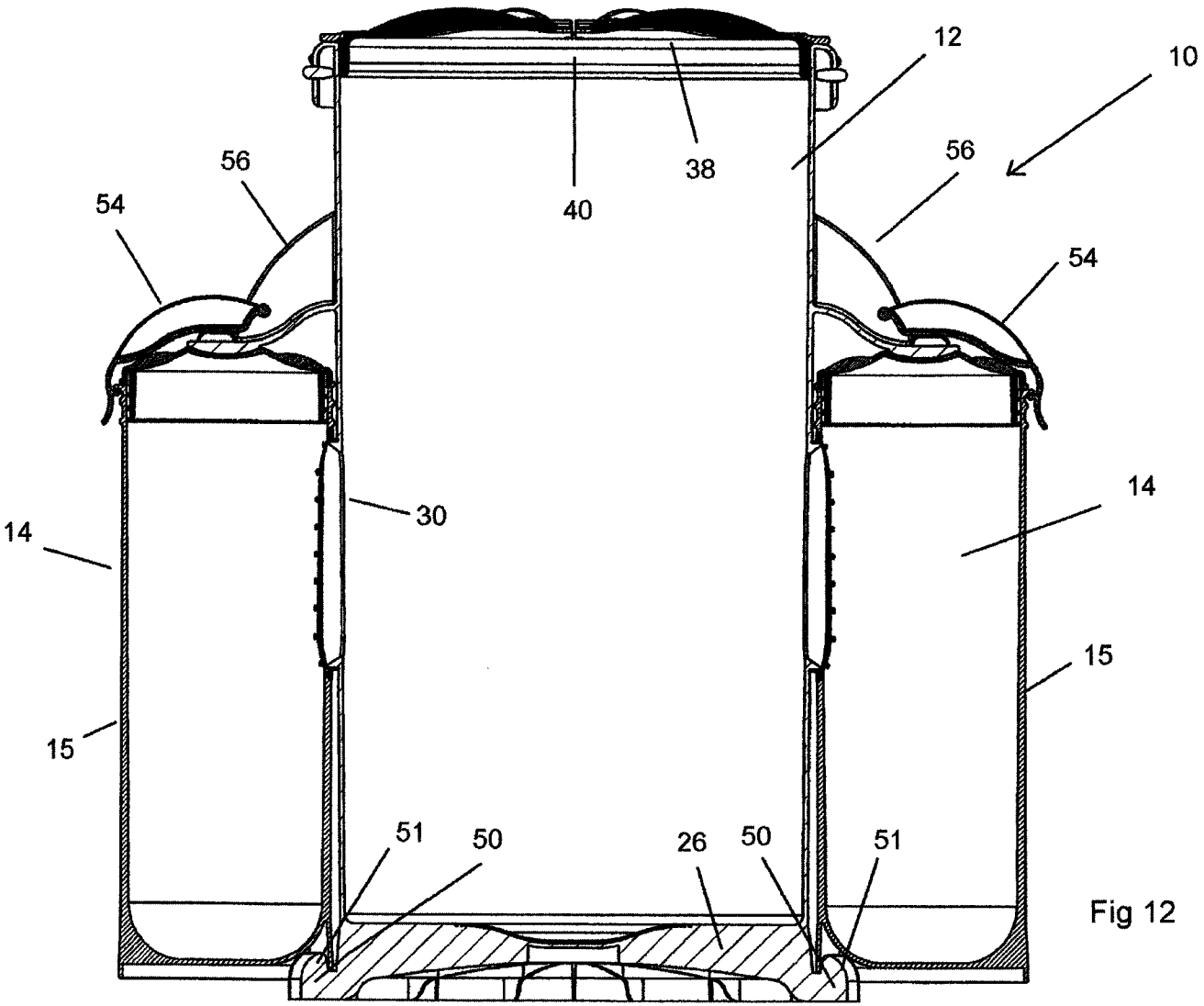
FIG. 12 is a side cross sectional view of the cleaning vessel of FIG. 9.
Figure 13:
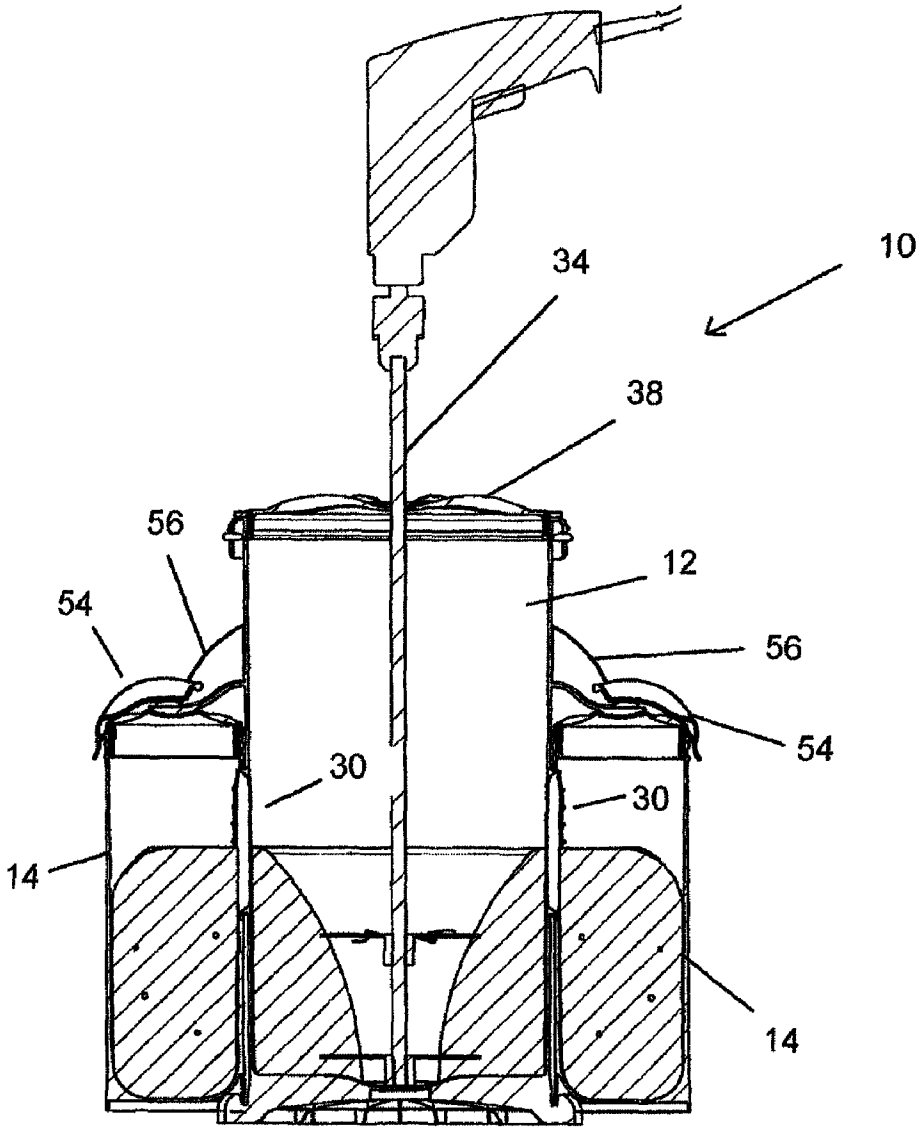
FIG. 13 is a side cross sectional view of the cleaning vessel of FIG. 9 in use.
Figure 14C:
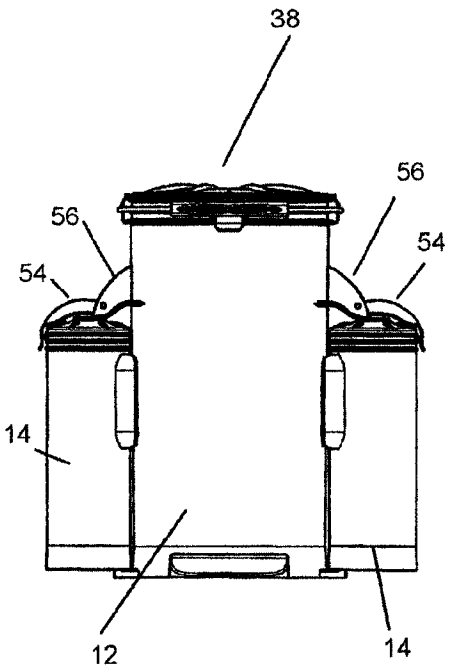
FIG. 14*c* is a side view of the cleaning vessel of FIG. 9 showing the secondary chambers fully attached.
Figure 14B:
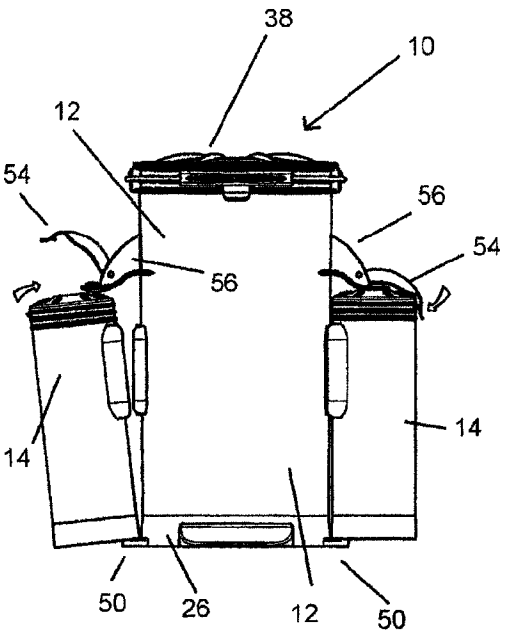
FIG. 14*b* is a side view of the cleaning vessel of FIG. 9 showing one of the secondary chambers partially attached.
Figure 14A:
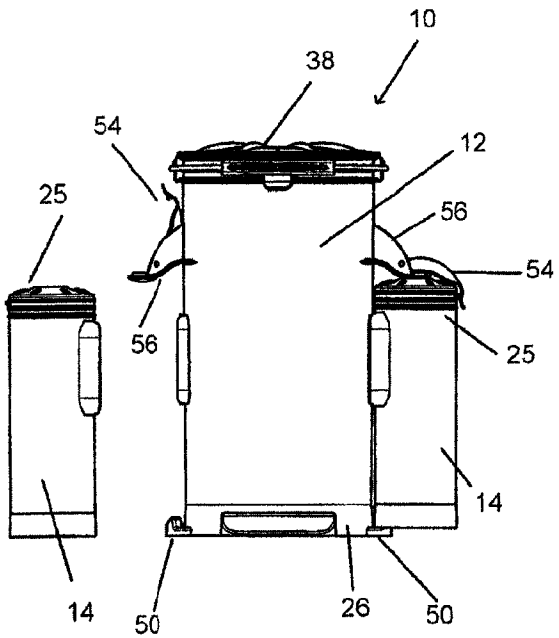
FIG. 14*a* is a side view of the cleaning vessel of FIG. 9 showing one of the secondary chambers detached.

The attachment of the secondary chambers 14 to the main chamber 12 may be via any suitable means. In the embodiment shown, the main chamber 12 is provided with a pair of outwardly extending tabs 50 adjacent the lower end thereof. The tabs 50 each include an upturned end 51. The tabs 50 are received in corresponding slots 52 (as can be seen in FIG. 11) adjacent the lower ends 22 of the secondary chambers 14. The upturned ends 51 are received in a recess in the lower end 22 of the secondary chambers 14 when the tabs 50 are received in the slots 52.

Also provided on the main chamber 12 adjacent upper ends 21 of the secondary chambers 14 are pivotable clips 54. The clips 54 are pivotally connected to outer ends of extending portions 56 on the main chamber 12. The extending portions 56 are located such that the outer ends thereof are located centrally above the upper ends 21 of the secondary chambers 14 in use. The pivotable clips 54 are provided such that when the secondary chambers 14 are in position and engaged with the tabs 50, the clips 54 pivot over and engage with the upper ends 21 of the secondary chambers 14 to hold the secondary chambers 14 in place. The secondary chambers 14 can then be removed as desired by releasing the clips 54.

Also, in the second embodiment, the upper ends 21 of the secondary chambers 14 are provided with removable caps 25. The removable caps 25 on the upper ends 21 of the secondary chambers 14 are provided to aid cleaning of the secondary chambers 14.

Figure 16B:
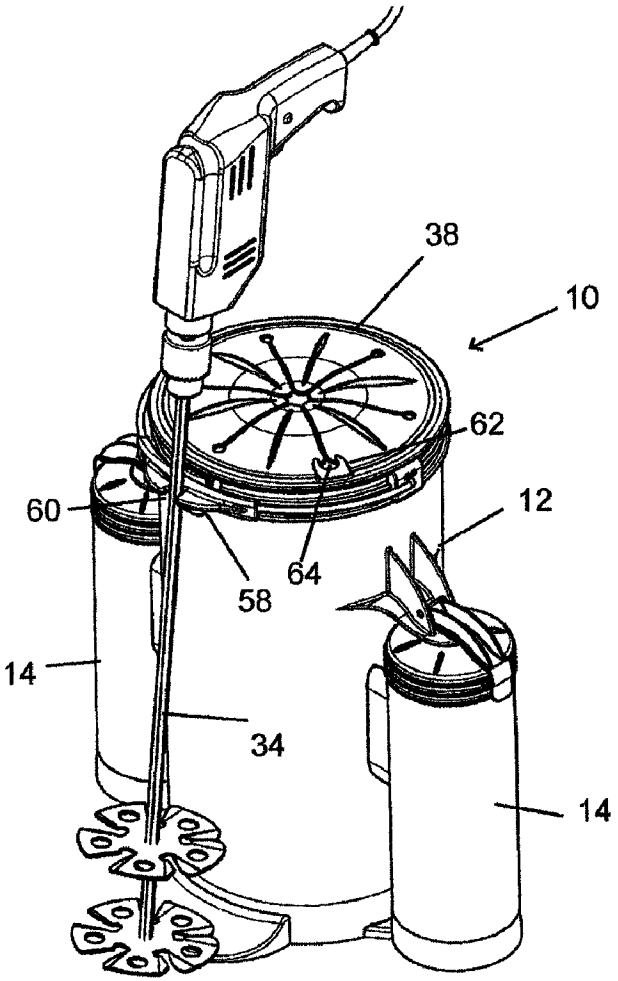
FIG. 16*b* is an upper perspective view showing the use of the first mixing attachment holding device.
Figure 16A:
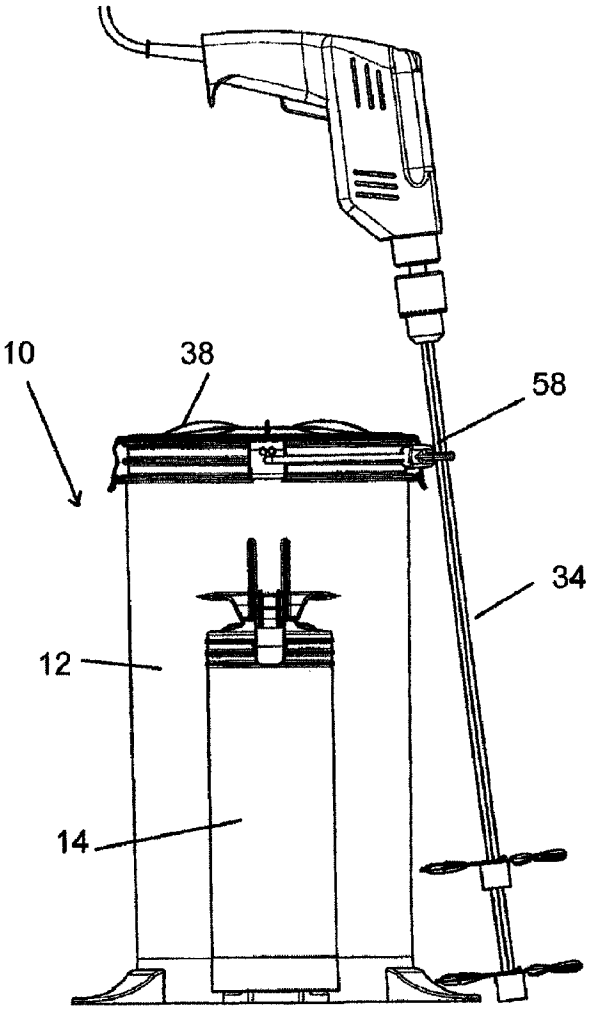
FIG. 16*a* is a side view of the cleaning vessel of FIG. 9 showing use of a first mixing attachment holding device.
Figure 17B:
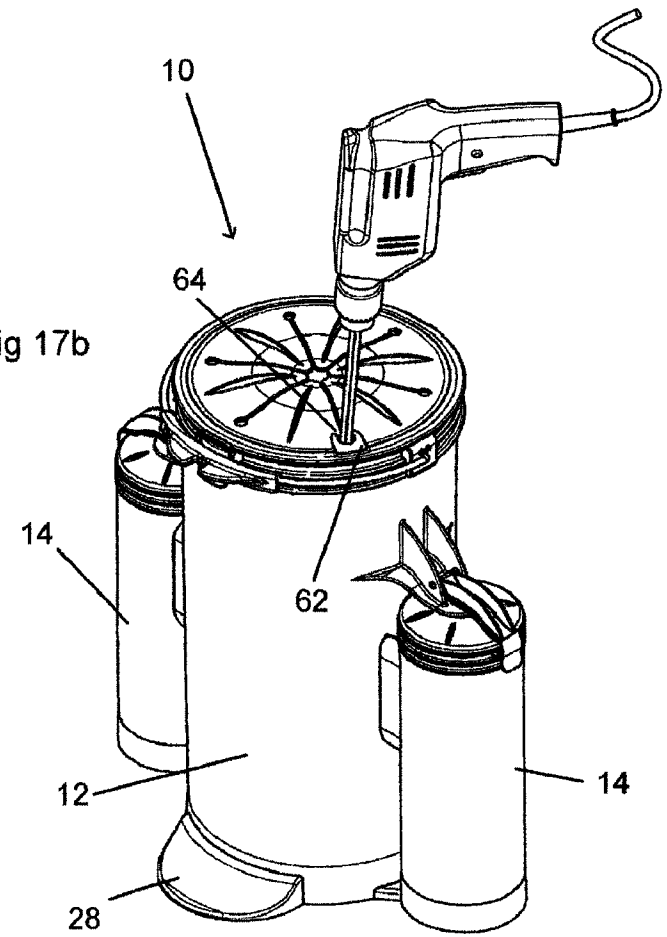
FIG. 17*b* is an upper perspective view showing the use of the second mixing attachment holding device.
Figure 17A:
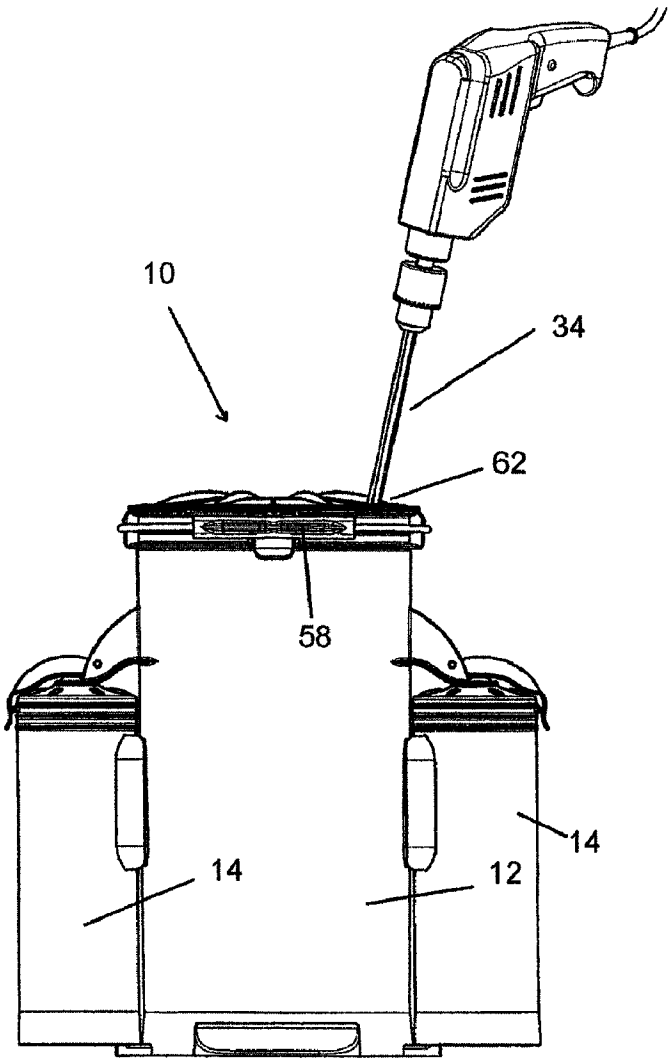
FIG. 17*a* is a side view of the cleaning vessel of FIG. 9 showing use of a second mixing attachment holding device.
Figure 18:
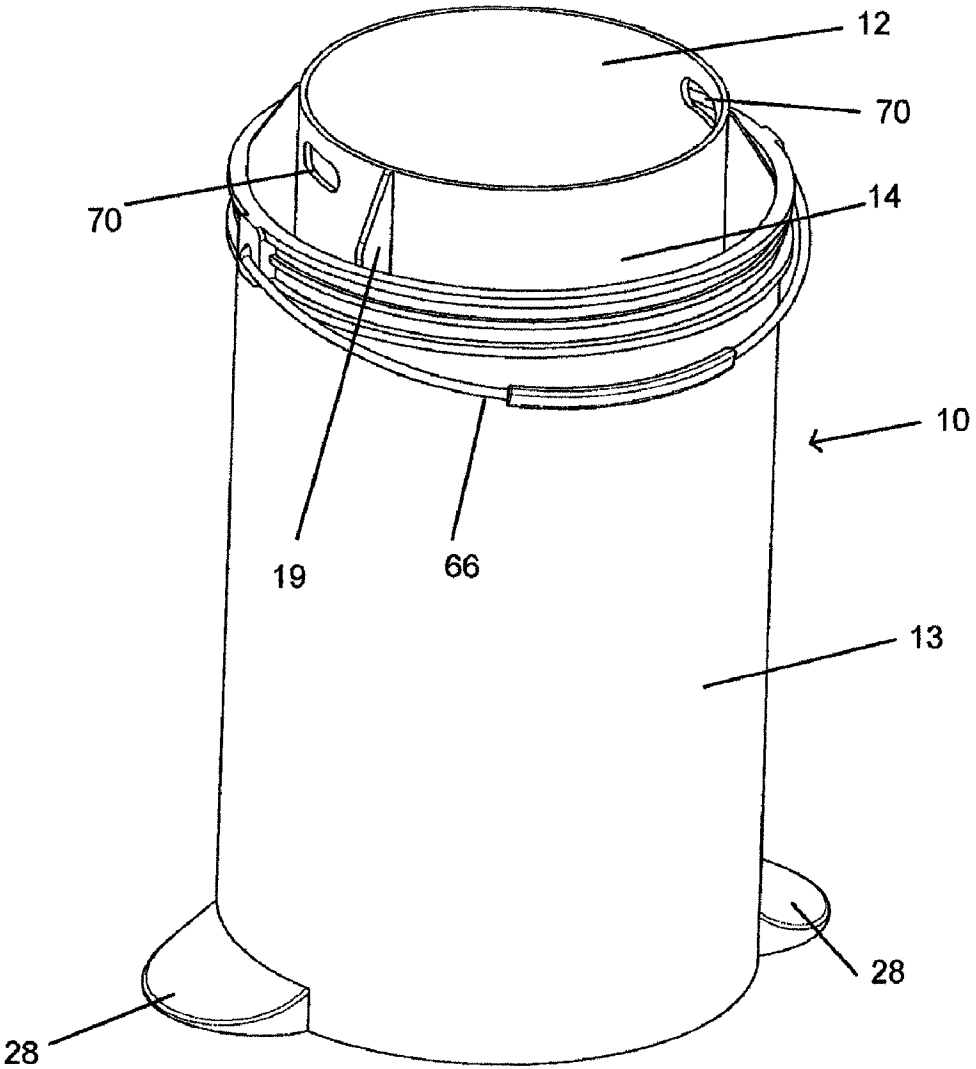
FIG. 18 is an upper perspective view of a third embodiment of a cleaning vessel in accordance with the present invention.
Figure 19:
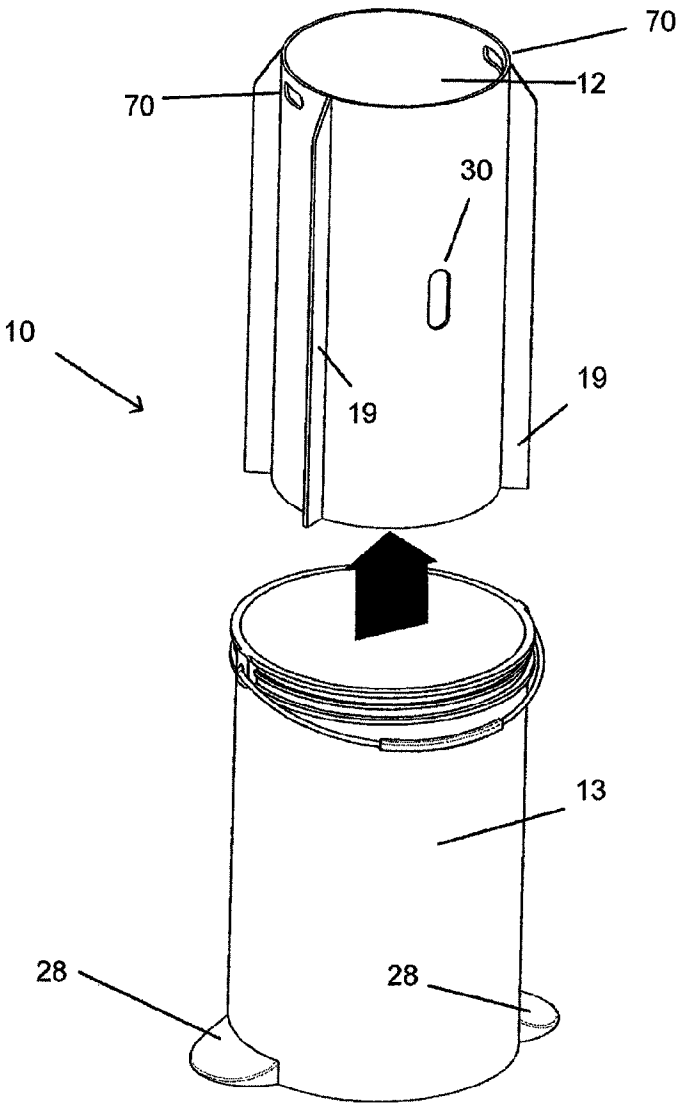
FIG. 19 is an exploded view of the cleaning vessel of FIG. 18.
Figure 20:
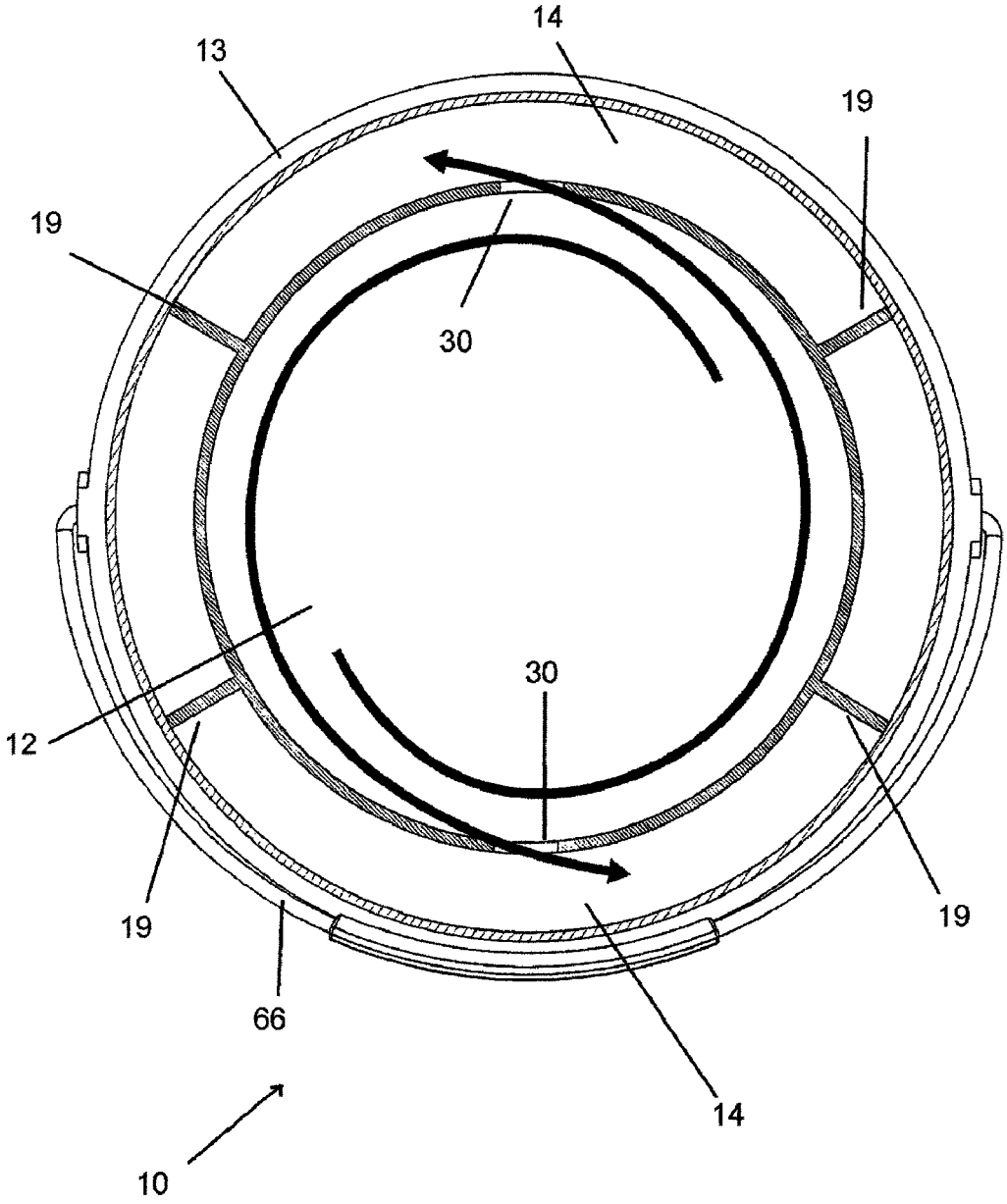
FIG. 20 is a top view of the cleaning vessel of FIG. 18 in use.
Figure 21:
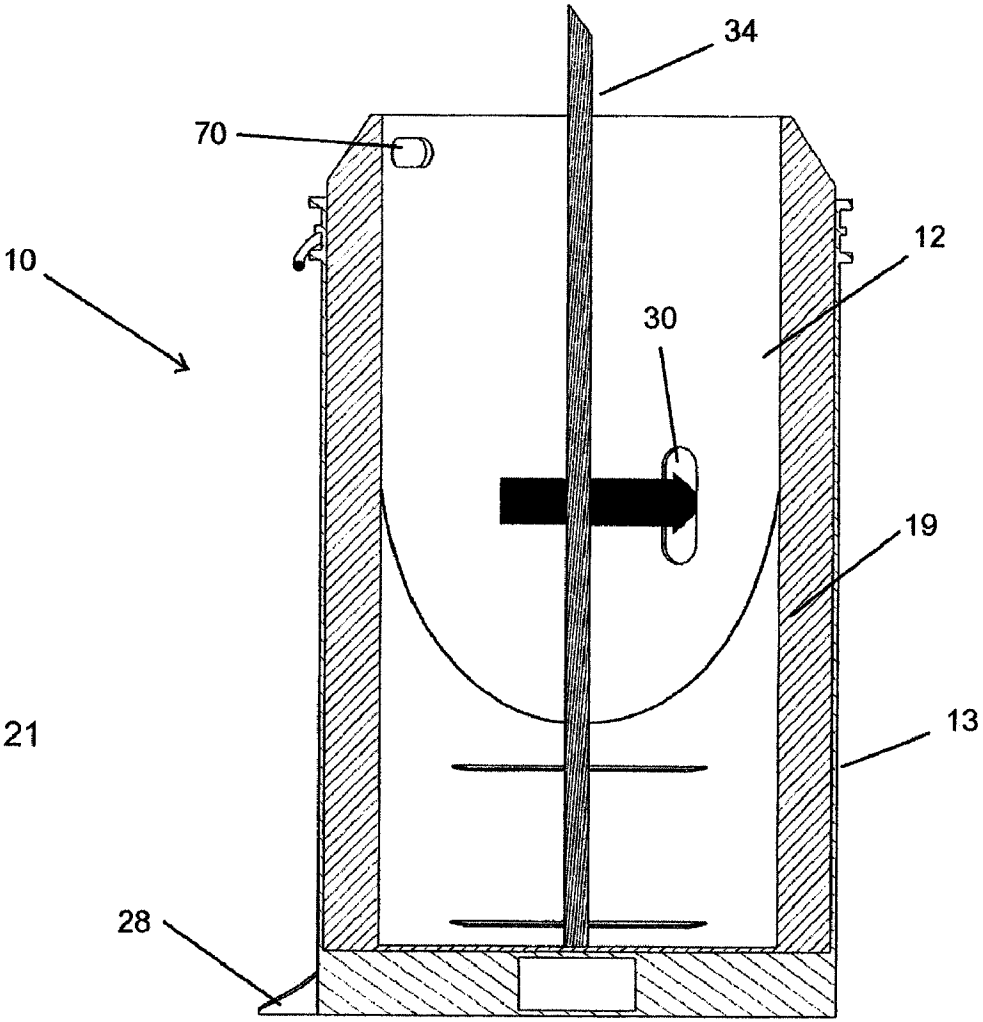
FIG. 21 is a side cross sectional view of the cleaning vessel of FIG. 18 in use.

As can be seen in FIG. 16, the cleaning vessel 10 is provided with a first mixing attachment holding device 58. The first holding device 58 is provided on the edge of the main chamber 12 adjacent the upper end thereof. The first holding device 58 comprises an outwardly extending piece of material having a first groove 60 therein such that the shaft of the mixing attachment 34 can be received and held in the groove 60. The first holding device 60 can therefore be used to hold the mixing attachment on the outside of the main chamber 14.

The cleaning vessel 10 may also be provided with a second mixing attachment holding device 62. The second holding device 62 extends from an upper edge of the main chamber across the cover member 38. The second holding device 62 includes a second groove 64 located above one of the slots 42 in the cover member 38 such that the shaft of the mixing attachment 34 can be received in the second groove 64 with the end of the mixing attachment 34 located in the main chamber 12.

Figure 15:
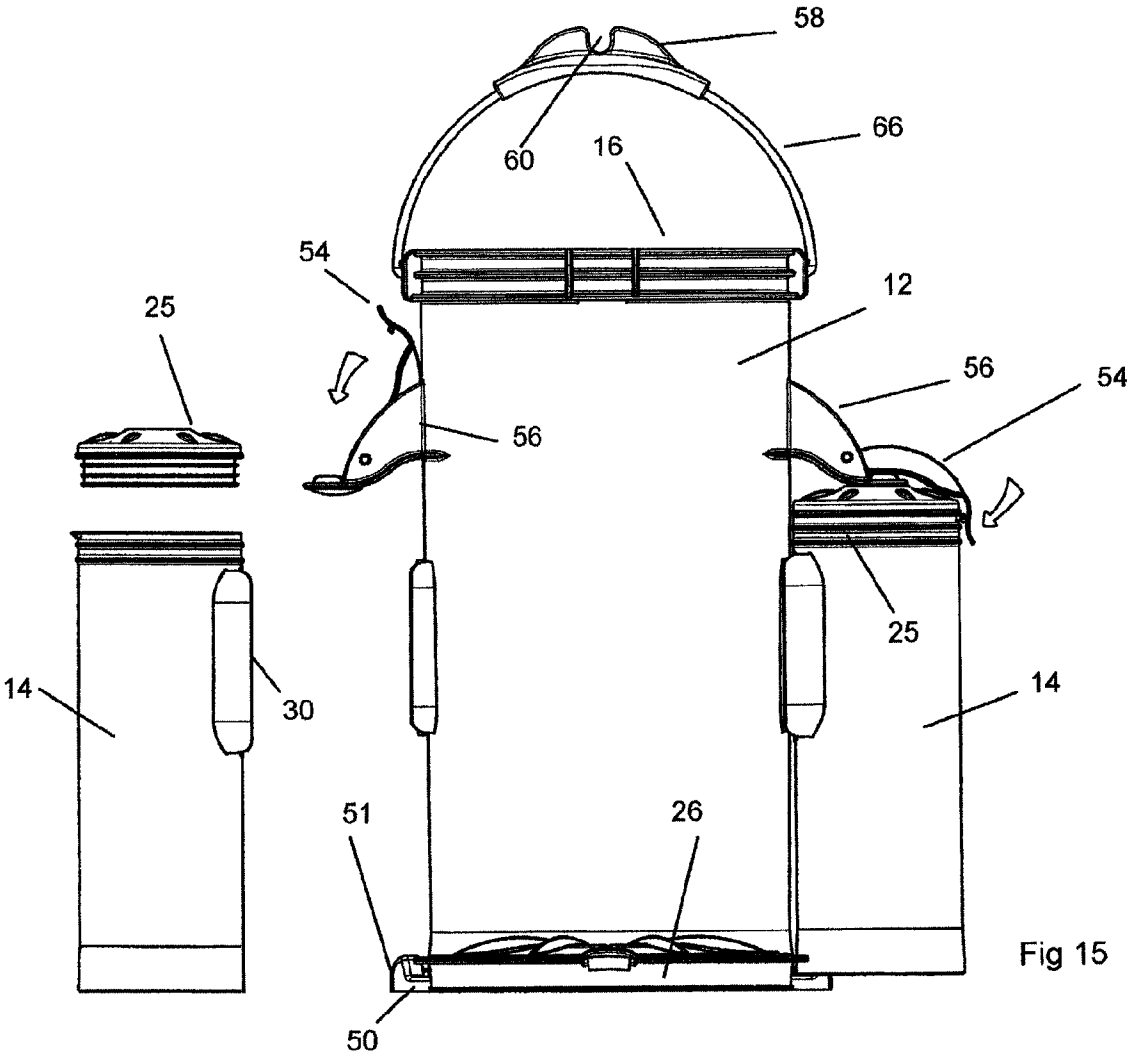
FIG. 15 is a side view of the cleaning vessel of FIG. 9 showing operation of the clips for attaching the secondary chambers.

The upper end of the main chamber 12 is also provided with a pivotable handle 66 as can be seen in FIG. 15 for carrying the cleaning vessel 10. In the embodiment shown, the first holding device 58 is provided on the handle 66 such that the first holding device 58 is located adjacent the upper end of the main chamber 12 when the handle 66 is folded down to a horizontal position.

FIGS. 18 to 21 show a third embodiment of a cleaning vessel 10 in accordance with the present invention. The embodiment of FIGS. 18 to 21 works in the same manner as the previous embodiments and like reference numerals are used to denote like parts.

The main chamber 12 comprises a cylindrical chamber that is received within an outer casing 13. The outer casing 13 comprises a cylindrical receptacle that receives the main chamber 12 such that the outer casing 13 and main chamber 12 are coaxial. An annular space is thereby defined between the outer casing 13 and the main chamber 12. Openings 30 are provided in the side wall of the main chamber 12 such that fluid may flow into the annular space between the main chamber 12 and the outer casing 13

An outer surface of the main chamber 12 is provided with a plurality of radial vanes 19 extending outwardly therefrom. The radial vanes 19 are arranged longitudinally on the outer surface of the main chamber extending to engage an inner surface of the outer casing 13 such that the annular space is divided into a plurality of segments. Each segment of the annular space into which an opening 30 is provided forms a secondary chamber 14. The secondary chambers 14 act to receive and accumulate material passing through the openings 30 from the main chamber 12.

In this embodiment, the foot pedals 28 are provided on the outer casing 13 adjacent the lower end thereof. Further, the main chamber 12 is provided with holes 70 on opposite sides thereof adjacent the upper end to act as handles by which the main chamber 12 can be grasped and pulled out of the outer casing 13 for cleaning.

It will be readily apparent to persons skilled in the relevant arts that various modifications and improvements may be made to the foregoing embodiments, in addition to those already described, without departing from the basic inventive concepts of the present invention.

What is claimed is:

1. A cleaning vessel comprising:

a main chamber into which can be inserted a part for cleaning, the main chamber comprising a cylindrical chamber such that rotation of the part creates a circular flow of fluid within the main chamber;

one or more secondary chambers; and openings provided in the main chamber such that the main chamber is in fluid communication with each secondary chamber;

wherein rotation of the part causes rotational flow of fluid in the main chamber, each opening is oriented such that material entrained in the rotating fluid passes from the main chamber into the secondary chamber and the secondary chambers each comprise a cylindrical chamber such that fluid entering each secondary chambers creates a circular flow within the secondary chamber in a direction opposite to that in the main chamber.

2. The cleaning vessel in accordance with claim 1, wherein a plurality of openings are provided in a side wall of the main chamber spaced evenly around the main chamber such that circular flow of fluid around the main chamber passes across the openings.

3. The cleaning vessel in accordance with claim 2, wherein the openings are provided in the side wall of the main chamber at a location above lower ends of the main chamber and the secondary chambers.

4. The cleaning vessel in accordance with claim 3, wherein each of the openings is provided with a vane extending inwardly from the side wall of the main chamber on a first side of the opening, the vane being angled such that fluid passing across the opening from a second side towards the first side is directed through the opening into the secondary chamber.

5. The cleaning vessel in accordance with claim 1, wherein the main and secondary chambers each comprise cylindrical vessels and each secondary chamber includes a side wall portion common with a side wall portion of the main chamber in which the opening is provided.

6. The cleaning vessel in accordance with claim 1, wherein the openings are provided adjacent upper ends of the secondary chambers.

7. The cleaning vessel in accordance with claim 1, wherein the main chamber is provided with two secondary chambers located on opposite sides of the main chamber.

8. The cleaning vessel in accordance with claim 1, wherein the secondary chambers each include a closed upper end and open lower end having a removable cap member.

9. The cleaning vessel in accordance with claim 8, wherein the secondary chambers are tapered such that the upper ends thereof are narrower than the lower ends and the upper closed end extends downwardly away from the opening to direct fluid flowing from the main chamber downwardly.

10. The cleaning vessel in accordance with claim 1, wherein the secondary chambers are provided as separate cylindrical vessels securable to and releasable from the main chamber each having an opening which aligns with a corresponding opening in the main chamber when the cylindrical vessel is attached to the main chamber.

11. The cleaning vessel in accordance with claim 10, wherein the main chamber is provided with a pair of outwardly extending tabs adjacent the lower end thereof each having an upturned end and the tabs are received in corresponding slots adjacent the lower ends of the secondary chambers.

12. The cleaning vessel in accordance with claim 11, wherein pivotable clips are provided on the main chamber adjacent upper ends of the secondary chambers such that when the secondary chambers are in position and engaged with the tabs, the clips pivot over and engage with the upper ends of the secondary chambers to hold the secondary chambers in place.

13. The cleaning vessel in accordance with claim 10, wherein the upper ends of the secondary chambers are provided with removable caps.

14. The cleaning vessel in accordance with claim 1, wherein a pair of foot pedals is provided extending outwardly from opposite sides of the lower end of the main chamber.

15. The cleaning vessel in accordance with claim 14, wherein the main chamber is provided with a base portion into which a lower end of the main chamber is received, the base portion including the foot pedals.

16. The cleaning vessel in accordance with claim 15, wherein the foot pedals are pivotally connected to the base portion such that the foot pedals can be pivoted between a first in use position and a second stored position.

17. The cleaning vessel in accordance with claim 16, wherein a lower surface of the main chamber is provided with lower surface vanes to direct fluid flow upwardly away from the lower surface in use.

18. The cleaning vessel in accordance with claim 17, wherein the lower surface vanes extend from a central position on the lower surface to the periphery thereof and have a first face angled to direct rotating fluid upward.

19. The cleaning vessel in accordance with claim 1, wherein the upper end of the main chamber includes a cover member to limit splashing of fluid out of the main chamber in use.

20. The cleaning vessel in accordance with claim 19, wherein the cover member comprises a flexible member having a central hole with a plurality of slots extending radially outwardly from a central hole.

21. The cleaning device in accordance with claim 20, wherein a first mixing attachment holding device is provided on the edge of the main chamber adjacent the upper end thereof, the first mixing attachment holding device comprising an outwardly extending piece of material having a first groove therein such that the shaft of the mixing attachment can be received and held in the groove.

22. The cleaning vessel in accordance with claim 21, wherein a second mixing attachment holding device is provided extending from an upper edge of the main chamber across the cover member the second mixing attachment holding device including a second groove located above one of the slots in the cover member such that the shaft of the mixing attachment can be received in the second groove with the end of the mixing attachment located in the main chamber.

23. The cleaning vessel in accordance with claim 22, wherein the upper end of the main chamber is provided with a pivotable handle and the first mixing attachment holding device is provided on the handle such that the first mixing attachment holding device is located adjacent the upper end of the main chamber when the handle is folded down to a horizontal position.

24. A cleaning vessel comprising:

a main chamber into which can be inserted a part for cleaning;

an outer casing into which the main chamber is received and a plurality of radial vanes extending outwardly from an outer surface of the main chamber such that the radial vanes engage an inner surface of the outer casing to define secondary chambers; and openings provided in the main chamber such that the main chamber is in fluid communication with each secondary chamber;

wherein rotation of the part causes rotational flow of fluid in the main chamber and each opening is oriented such that material entrained in the rotating fluid passes from the main chamber into the secondary chamber.

25. The cleaning vessel in accordance with claim 24, wherein the main chamber and outer casing are cylindrical and the main chamber is received coaxially within the outer casing.

26. The cleaning vessel in accordance with claim 25, wherein radial vanes are arranged longitudinally on the outer surface of the main chamber to divide the annular space defined between the outer casing and the main chamber into a plurality of segments and the openings are provided in the main chamber such that segments defined between a pair of adjacent vanes either side of an opening form the secondary chambers.

27. The cleaning vessel in accordance with claim 26, wherein the foot pedals are provided on the outer casing adjacent the lower end thereof.

28. The cleaning vessel in accordance with claim 27, wherein the main chamber is provided with holes on opposite sides thereof adjacent the upper end to act as handles by which the main chamber can be grasped and pulled out of the outer casing for cleaning.

* * * * *